US010035622B2

(12) United States Patent
Gartz et al.

(10) Patent No.: US 10,035,622 B2
(45) Date of Patent: Jul. 31, 2018

(54) DISPOSABLE TRAY

(71) Applicant: PACTIV LLC, Lake Forest, IL (US)

(72) Inventors: Mark R. Gartz, Mt. Prospect, IL (US); H. Bernard Kirkland, Lindenhurst, IL (US)

(73) Assignee: PACTIV LLC, Lake Forest, IL (US)

( * ) Notice: Subject to any disclaimer, the term of this patent is extended or adjusted under 35 U.S.C. 154(b) by 0 days.

(21) Appl. No.: 14/805,752

(22) Filed: Jul. 22, 2015

(65) Prior Publication Data

US 2017/0021957 A1 Jan. 26, 2017

(51) Int. Cl.
*B65D 25/04* (2006.01)
*B65D 1/36* (2006.01)

(52) U.S. Cl.
CPC ..... *B65D 1/36* (2013.01)

(58) Field of Classification Search
CPC ..... B65D 1/36; B65D 25/04; A47G 23/06
USPC ..... 220/507, 555, 553
See application file for complete search history.

(56) References Cited

U.S. PATENT DOCUMENTS 1,542,927 A * 6/1925 Whitaker ..... B65D 9/14 206/170
2,162,162 A * 6/1939 De Murguiondo ..... F25C 1/24 217/26.5
2,784,434 A * 3/1957 Little ..... A47L 13/50 220/555
3,341,876 A * 9/1967 Campbell ..... A47L 13/58 15/1
3,367,529 A * 2/1968 Welch ..... A47J 47/16 206/162
3,942,671 A * 3/1976 Florian ..... B65D 1/36 206/564
2001/0000732 A1* 5/2001 Hopkins, Sr. ..... B65D 43/162 426/106

* cited by examiner

*Primary Examiner* — Stephen Castellano
(74) *Attorney, Agent, or Firm* — Baker Botts L.L.P.

(57) ABSTRACT

Disposable tray includes a base and a perimeter wall. The perimeter wall extends upwardly from the base to define an interior. The perimeter wall includes a set of opposing first sidewalls and a set of opposing second sidewalls. Each of the opposing first sidewalls having a first maximum height above the base and each of the opposing second sidewalls having a second maximum height above the base. The tray further includes a divider wall extending upwardly from the base. The divider wall extends between the set of opposing second sidewalls to define a plurality of compartments. The divider wall intersects each of the opposing second sidewalls proximate the second maximum height. The second maximum height is greater than the first maximum height.

23 Claims, 10 Drawing Sheets

DISPOSABLE TRAY

BACKGROUND

Field of Disclosed Subject Matter

The present disclosed subject matter relates to disposable trays, for example disposable multi-compartment lunch trays.

Description of Related Art

Trays allow users to carry a plurality of items, for example various food items. In some instances, a user may wish to keep certain food items separate from other food items. To keep the items separate, compartmental dividers can be added to the trays. However, disposable trays, for example, thermoformed trays, can be weakened by added compartmental dividers. This can be due to a reduction in the height of the sidewall of the tray formed in the area of the divider.

Various techniques have been attempted in an effort to strengthen trays having dividers. However, such techniques generally have been unsatisfactory or render undesirable disadvantages, such as reduced flush-fill volume or inhibited access to contents of the tray.

As such, there is a continued need for a disposable tray having a divider with improved strength, yet increased flush-fill volume and uninhibited access to the contents of the tray.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a disposable tray. The disposable tray includes a base and a perimeter wall. The perimeter wall extends upwardly from the base to define an interior. The perimeter wall includes a set of opposing first sidewalls and a set of opposing second sidewalls. Each of opposing first sidewalls has a first maximum height above the base, and each of opposing second sidewalls has a second maximum height above the base. The disposable tray also includes a first divider wall extending upwardly from the base. The divider wall extends between the set of opposing second sidewalls to define a plurality of compartments within the interior. The divider wall intersects each of the opposing second sidewalls proximate the second maximum height thereof. The second maximum height is greater than the first maximum height.

As embodied herein, each of the opposing second sidewalls can further have a minimum height above the base, and the minimum height can be about equal to the first maximum height. Each of the second sidewalls can be arced in cross-section. The second maximum height can be at least about 12% greater than the first maximum height. The tray can further include a flange extending along an upper end of the perimeter wall, such as a return flange. The return flange can be rectangular, curved, an S-shape, a triangular shape, an angled shape, or a stepped shape. The perimeter wall can extend upwardly at an angle from the base.

Additionally, and as embodied herein, the divider wall can include a height above the base. The second maximum height can be about 120 percent the height of the divider wall. The divider wall can be straight in plan view, contoured in plan view, or a combination of both straight and contoured regions. The divider wall can increase in width proximate the intersection with each of the opposing second sidewalls. The tray can further include at least a secondary divider wall disposed between the first divider wall and one of the opposing first sidewalls to define a plurality of compartments therebetween. The tray can weigh less than 25 grams and at least 3.5 pounds applied proximate a midpoint of one of the first set of sidewalls can be required for deflection of at least about 1 inch. The tray can weigh less than 25 grams and at least 4.0 pounds applied proximate a midpoint of one of the first set of sidewalls can be required for deflection of at least about 1 inch.

Furthermore, and as embodied herein, the tray can comprise material selected from the group of polystyrene foam, ridged sheet, molded fiber, and aluminum.

The disclosed subject matter also includes a method of making a disposable tray having some or all of the features described herein, as well as a stack of a plurality of such strays. As recognized in the art, the tray disclosed herein can include some or all of the features described herein, or any suitable combination thereof.

DETAILED DESCRIPTION OF THE PREFERRED EMBODIMENT

Figure 1:
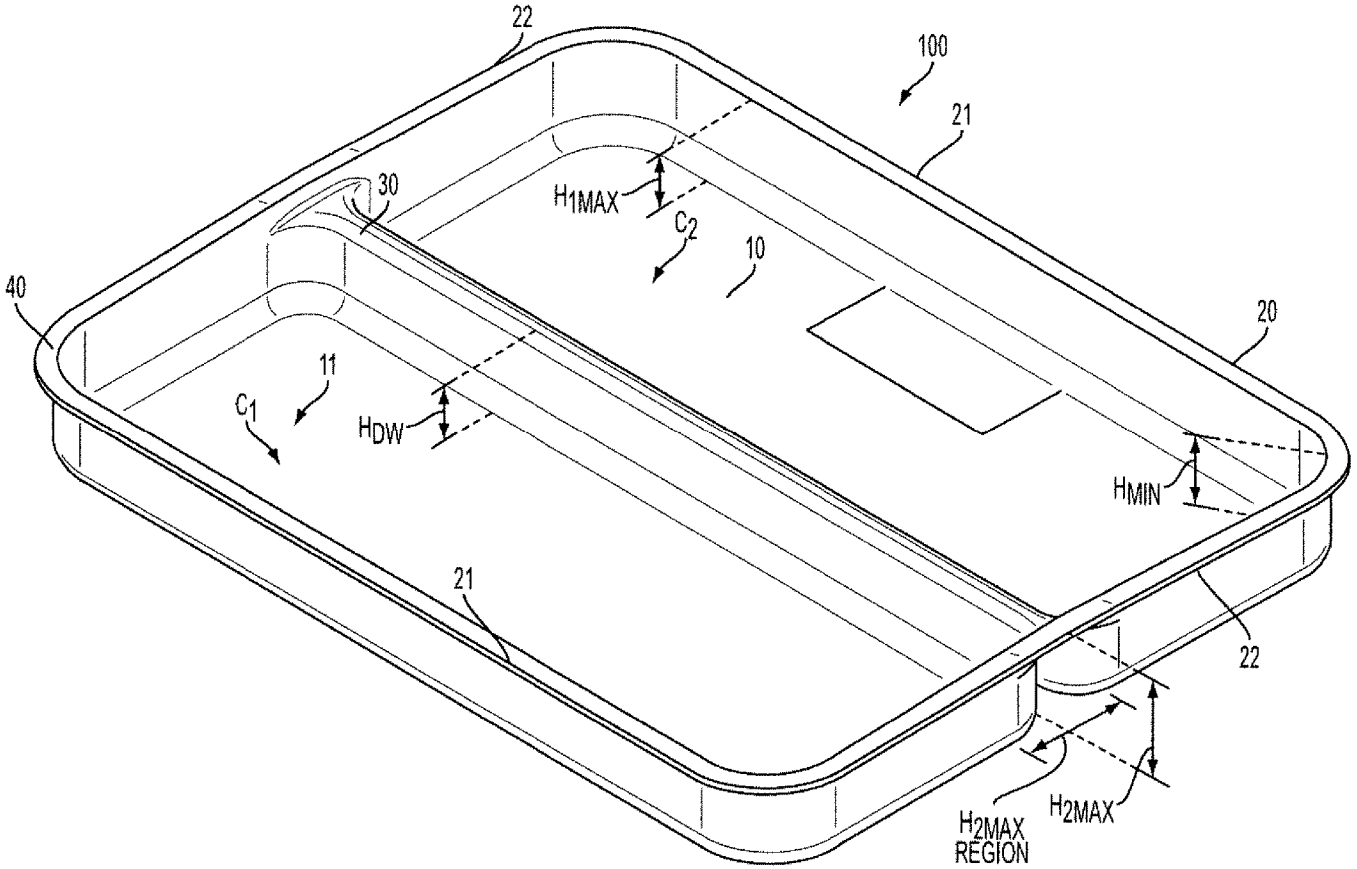
FIG. 1 is a perspective view of an exemplary embodiment of a disposable tray according to the disclosed subject matter.
Figure 2:
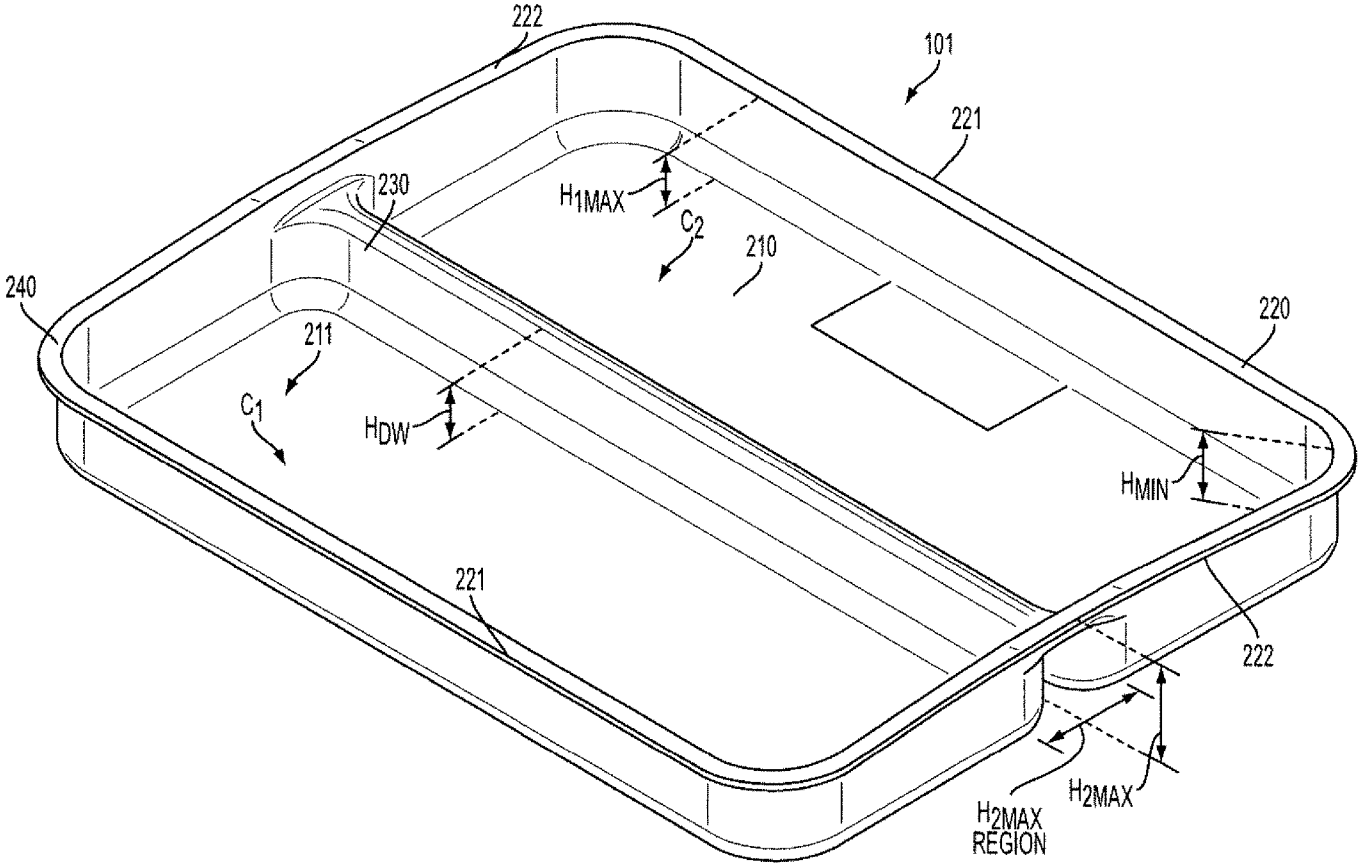
FIGS. 2-4 each is a perspective view of variations of the exemplary embodiment of the disposable tray of FIG. 1, wherein the difference is the maximum height of each of the opposing second sidewalls is increased relative to the base.
Figure 3:
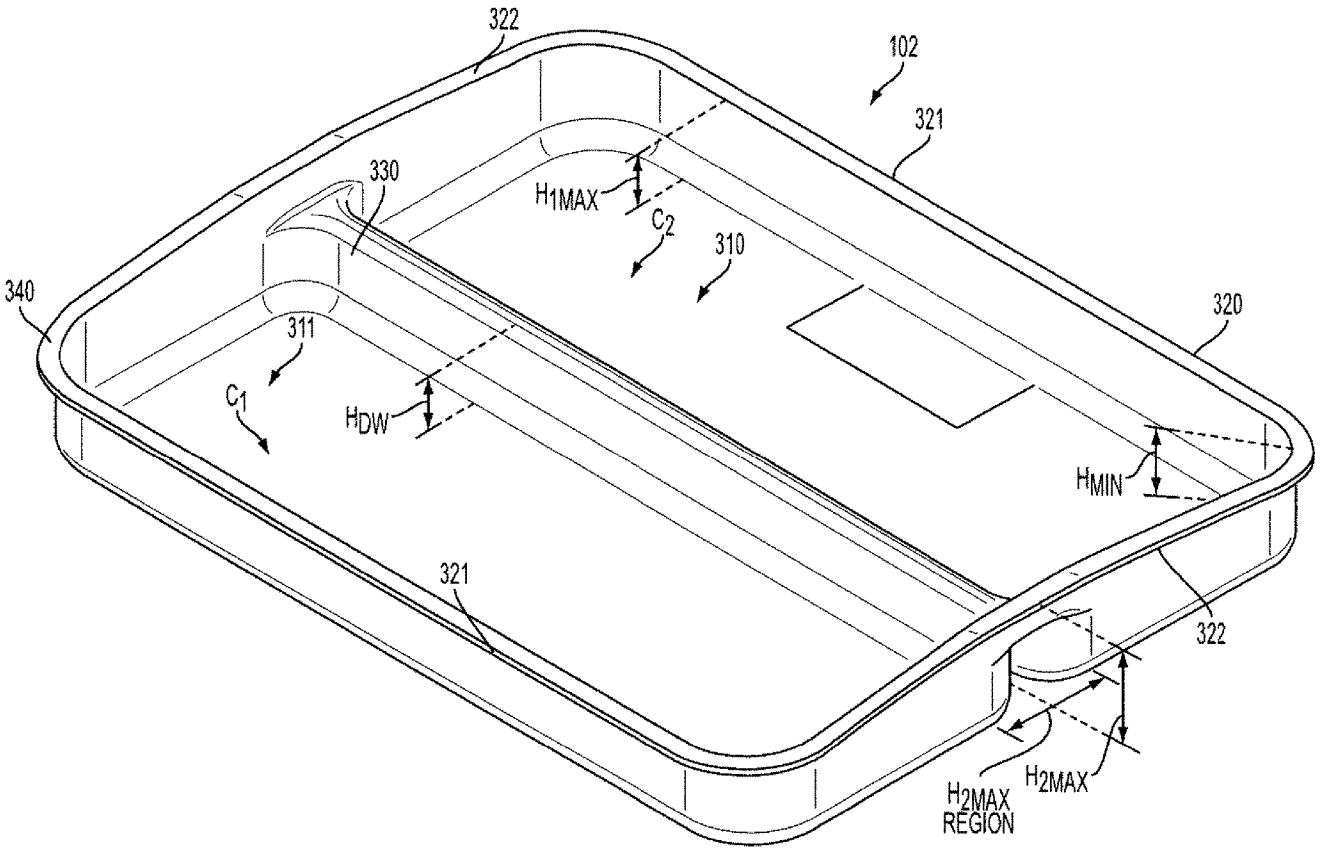
Figure 4:
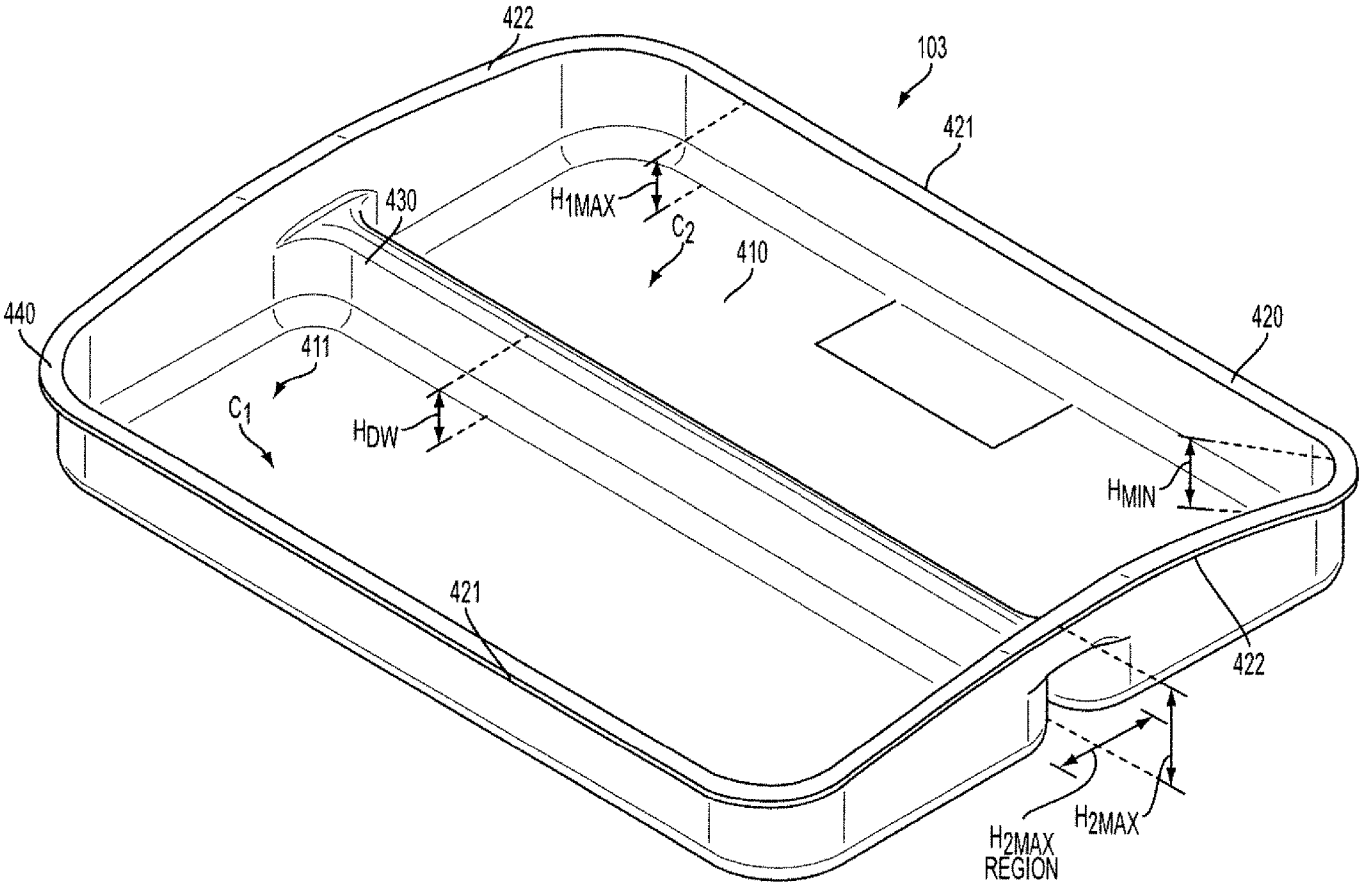
Figure 5:
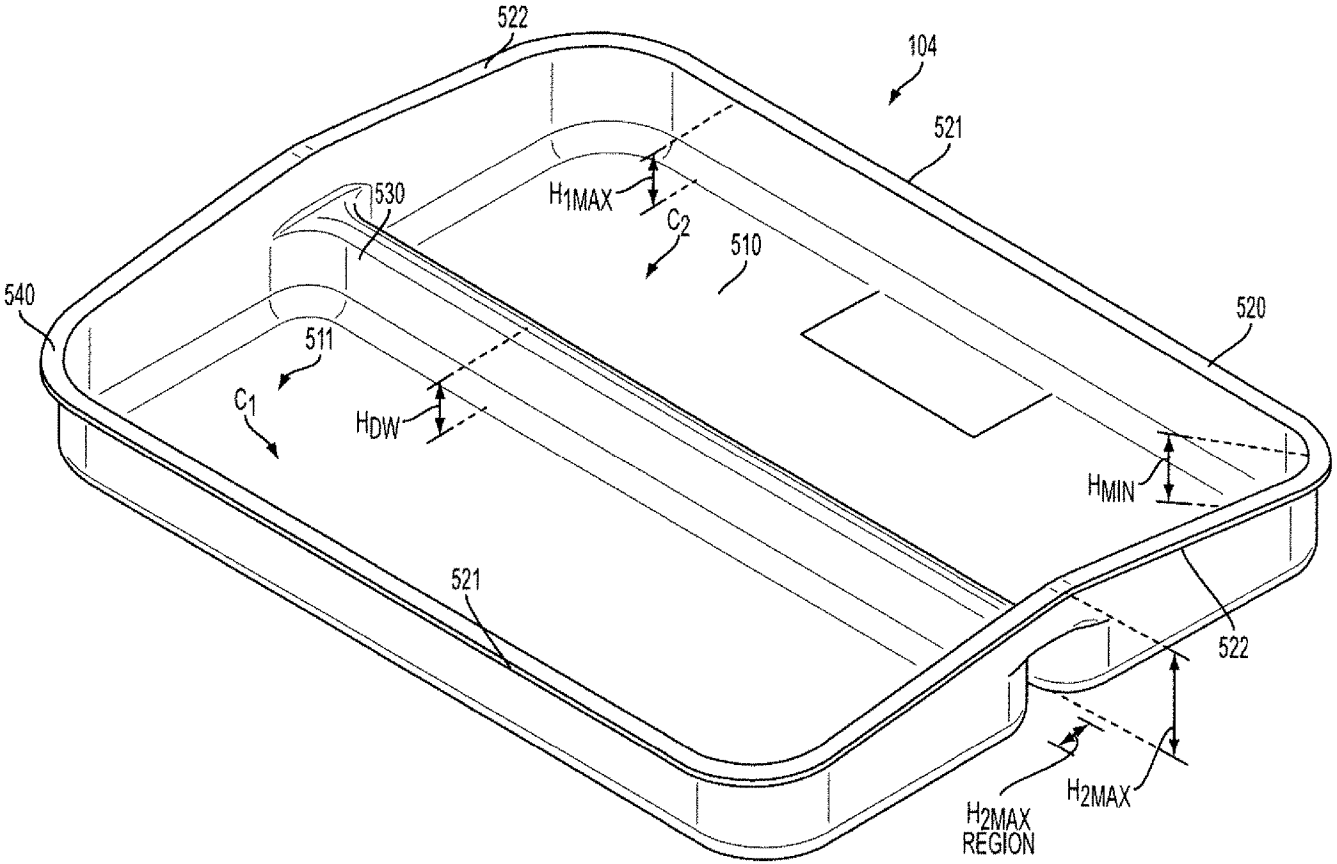
FIG. 5 is a perspective view of another exemplary embodiment of a disposable tray according to the disclosed subject matter, wherein the width of the maximum height region of each of the opposing second sidewalls is decreased.
Figure 6:
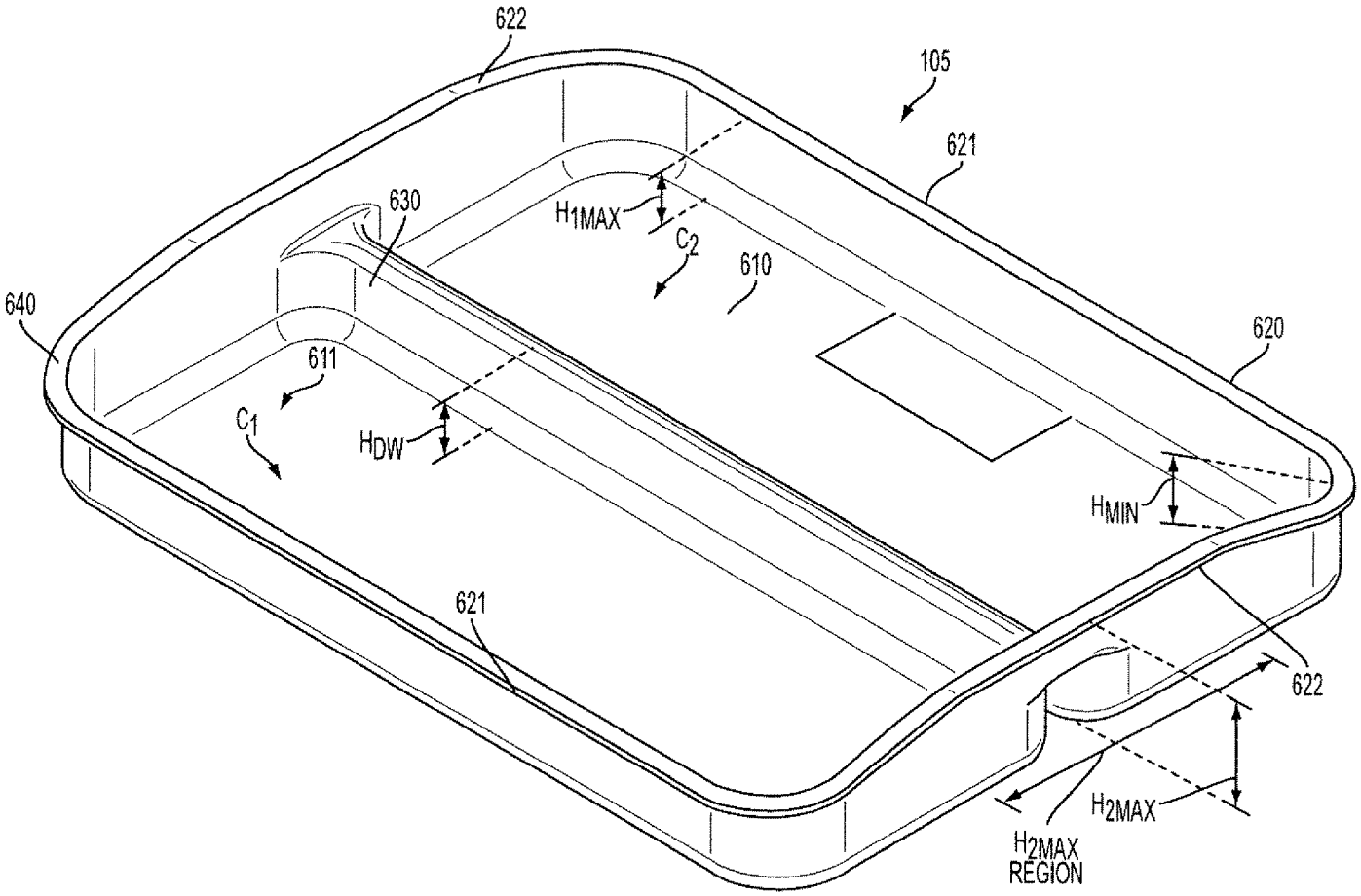
FIG. 6 is a perspective view of yet another exemplary embodiment of a disposable tray according to the disclosed subject matter, wherein the width of the maximum height region of each of the opposing second sidewalls is increased.

Reference will now be made in detail to the various exemplary embodiments of the disclosed subject matter, exemplary embodiments of which are illustrated in the accompanying drawings. The structure and corresponding method of making and using the disclosed subject matter will be described in conjunction with the detailed description of the disposable tray.

The apparatus presented herein can be used for a tray. As used herein, "tray" and "disposable tray" will be used interchangeably to refer to disposable devices for holding and transporting food items and other perishable and non-perishable products. As used herein, the term "disposable" refers to an item intend to be discarded after limited use due to the cost of manufacture and relative durability. Use is not limited to a one-time use and can apply to items used a number of times before being discarded. As used herein, the term "about" is intended to mean within a suitable range of tolerance as recognized by one of skill in the art.

In accordance with the disclosed subject matter herein, the disposable tray generally includes base and a perimeter wall. The perimeter wall extends upwardly from the base to define an interior. The perimeter wall includes a set of opposing first sidewalls and a set of opposing second sidewalls. Each of opposing first sidewalls has a first maximum height above the base and each of opposing second sidewalls has a second maximum height above the base. The disposable tray also includes a first divider wall extending upwardly from the base. The divider wall extends between the set of opposing second sidewalls to define a plurality of compartments within the interior. The divider wall intersects each of the opposing second sidewalls proximate the second maximum height thereof. The second maximum height is greater than the first maximum height.

The accompanying figures, where like reference numerals refer to identical or functionally similar elements, throughout the separate views, serve to further illustrate the various embodiments and to explain various principles and advantages all in accordance with the disclosed subject matter. For purpose of explanation and illustration, and not limitation, exemplary embodiments of the disposable tray are shown in FIGS. 1-9. The disposable tray is suitable for use with a wide variety of hot and cold food items, such as fruit slices, chips, bread sticks, candies, and other suitable bite-size food items, alone or in combination with larger food items, such as pizza, tacos, burritos, burgers, or the like. The disposable tray is also suitable and beneficial for use with hot, prepared food items, such as chicken nuggets, French fries, onion rings, and popcorn shrimp, that are typically served with a condiment for dipping, such as ketchup, mustard, mayonnaise, or vinegar, wherein the tray can be used for storing, transporting, and/or re-using such food items as well as serving the food items and allowing for dipping of the food items into the condiment. Food items can be placed directly on the tray surface, or contained in secondary packaging, for example, cartons, portion cups, fry boats or the like. It will be recognized that the disposable tray can also be suitable for storing, transporting, and/or re-using non-food items, such as electronic components, mechanical parts, tools, toys or any other suitable non-food items. For purpose of illustration only, and not limitation, reference will made herein to a disposable tray intended to contain food items. The disposable tray described herein, and methods of using the tray, are not limited to the illustrative embodiments described or depicted herein.

For the purpose of illustration, and not limitation, reference is made to an exemplary embodiment of a disposable tray in accordance with the disclosed subject matter. With reference to FIG. 1, a disposable tray 100 is depicted having a base 10 and a perimeter wall 20. The perimeter wall 20 extends upwardly from the base 10 to define an interior 11. The perimeter wall 20 includes a set of opposing first sidewalls 21 (e.g., front and rear sidewalls). Each of the opposing first sidewalls 21 has a first maximum height $H_{1MAX}$ above the base 10. The perimeter wall 20 also includes a set of opposing second sidewalls 22 (e.g., endwalls). Each of the opposing second sidewalls 22 has a second maximum height $H_{2MAX}$ above the base 10. The second maximum height $H_{2MAX}$ can be greater than the first maximum height $H_{1MAX}$. For example, in some embodiments, the second maximum height $H_{2MAX}$ can be at least about 12% greater than the first maximum height $H_{1MAX}$. Additionally, each of the opposing second sidewalls 22 can further have a minimum height $H_{MIN}$ above the base 10. For example, the second maximum height $H_{2MAX}$ can be between about 10% and 30% greater than the minimum height $H_{MIN}$. The minimum height $H_{MIN}$ can be about equal to the first maximum height $H_{1MAX}$. As used herein, the term "about" is intended to mean within a suitable range of tolerance as recognized by one of skill in the art.

The tray of the disclosed subject matter also includes a first divider wall 30, which extends upwardly from the base 10. The divider wall 30 can extend between the set of opposing second sidewalls 22 to define a plurality of compartments ($C_1$ and $C_2$) within the interior 11. The first divider wall 30 intersects each of the opposing second sidewalls 22 proximate the second maximum height $H_{2MAX}$ of each second sidewall 22. As shown for example in FIG. 1, the divider wall can be substantially straight in plan view so as to define a generally planar wall. Additionally, or alternatively, and as described further below, the divider can be contoured along its length in plan view. Furthermore, the divider wall 30 has a height $H_{DW}$ above the base 10. In some embodiments, the second maximum height $H_{2MAX}$ can be at least about 120 percent the height of the divider wall $H_{DW}$. As embodied herein, the height of the divider wall $H_{DW}$ can be constant along the length of the divider wall. Alternatively, the height $H_{DW}$ can vary along the length of the divider wall 30. This variation in height can be less than 15% of the height $H_{DW}$. For example, the maximum height of the divider wall 30 can be located at the center of the tray and the minimum height of the divider wall 30 can be located near the intersection with each of the opposing second sidewalls 22.

Providing a second maximum height $H_{2MAX}$ above the intersection of the divider wall 30 and each of the opposing second sidewalls 22 increases the overall strength of the tray, for example in comparison to conventional trays having walls of relative uniform height (collectively referred to as "flat trays"). For example, flat trays can have $H_{2MAX}$ equal to $H_{MIN}$ (plus or minus 5%). As illustrated in FIGS. 1-6, opposing second sidewalls 22 (222, 322, 422, 522, 622) and the opposing first sidewalls 21 (221, 321, 421, 521, 621) can be provided with a range of relative dimensions (i.e., $H_{2MAX}$-$H_{1MAX}$) and ratios, for example depending on the desired application, features, and/or aesthetic variations of the disposable tray. Such variations in dimensions can include the height $H_{2MAX}$ and $H_{1MAX}$, as well as the width of the $H_{2MAX}$ region, depending on the desired application, features, and/or aesthetic variations of the disposable tray. For purpose of illustration and not limitation, and as embodied herein, Table 1 provides exemplary dimensions of each of the embodiments of FIGS. 1-6. For purpose of comparison, Table 1 also provides a relative measure of strength as determined by finite element analysis of each of the embodiments compared to a conventional flat tray having substantially similar construct, including material of construct and overall dimensions other than $H_{2MAX}$-$H_{1MAX}$ (and therefore ratio of $H_{2MAX}$ to $H_{1MAX}$) and the width of the $H_{2MAX}$ region as noted below. As shown for example in Table 1, the disposable tray increases in strength as the height of each of the opposing second sidewalls increases relative the height of each of the opposing first sidewalls, and likewise relative the height of the divider wall, which is constant for each of the trays in Table 1. Additionally, increasing the width of the $H_{2MAX}$ region can also increase the strength of the disposable tray. For example, with a $H_{2MAX}$ of 1.125" and a width of $H_{2MAX}$ region of 1.300", strength can be increased by 45.8%; with a $H_{2MAX}$ of 1.250" and a width of $H_{2MAX}$ region of 1.300", strength can be increased by 68.2%; with a $H_{2MAX}$ of 1.375" and a width of $H_{2MAX}$ region of 1.300", strength can be increased by 75.3%; with a $H_{2MAX}$ of 1.500" and a width of $H_{2MAX}$ region of 1.300", strength can be increased by 79.8%; with a $H_{2MAX}$ of 1.500" and a width of $H_{2MAX}$ region of 0.100", strength can be increased by 78.5%; and with a $H_{2MAX}$ of 1.500" and a width of $H_{2MAX}$ region of 3.300", strength can be increased by 80.3%.

TABLE 1

| FIG. | Embodiment | $H_{2MAX}$ | $H_{1MAX}$ | $H_{2MAX}-H_{1MAX}$ | Width of $H_{2MAX}$ region | Increased strength vs. flat trays |
|---|---|---|---|---|---|---|
| 1 | 100 | 1.125" | 1.000" | 0.125" | 1.300" | 45.8% |
| 2 | 101 | 1.250" | 1.000" | 0.250" | 1.300" | 68.2% |
| 3 | 102 | 1.375" | 1.000" | 0.375" | 1.300" | 75.3% |
| 4 | 103 | 1.500" | 1.000" | 0.500" | 1.300" | 79.8% |
| 5 | 104 | 1.500" | 1.000" | 0.500" | 0.100" | 78.5% |
| 6 | 105 | 1.500" | 1.000" | 0.500" | 3.300" | 80.3% |

For purpose of illustration and not limitation tests were performed on actual samples of various tray configurations. Table 2 illustrates that providing a second maximum height $H_{2MAX}$ above the intersection of the divider wall 30 and each of the opposing second sidewalls 22 increases deflection strength and allows for lighter trays, as compared to flat trays (i.e., flat sidewalls, as described above). In Table 2, the trays of Groups 1 and 2 utilize trays designed in accordance with the disclosed subject matter. For example, the trays of Groups 1 and 2 include a second maximum height $H_{2MAX}$ above the intersection of the divider wall 30. Furthermore, the trays of Groups 1 and 2 weigh on average 23.824 g and 24.37 g, respectively, and require 4.7 lb and 4.7 lb to deflect the tray 1 inch. When describing deflection measurements herein, the tray can be held at opposing corners, for example, where one of the first set of opposing sidewalls meets each of the second set of opposing sidewalls. The force can be applied proximate the middle of the other of the first set of opposing sidewalls, and deflection can be measured at the same location. Groups 3-5 utilize conventional flat trays as known in the art. The trays of Groups 3-5 weigh, on average, 25.622 g, 26.006 g, and 27.7 g, respectively. By contrast, the trays of Groups 3-5 require 3.5 lb, 3.1 lb, and 1.7 lb, respectively, to deflect the tray 1 inch. All the trays of Table 2 are made from the same molded fiber composition, as recognized in the art. Table 2 illustrates that the trays of Group 1 and 2 are lighter than conventional flat trays, yet require more weight to deflect 1 inch (i.e., are stronger) than the conventional trays of Groups 3-5. As a result, tray weight can be reduced without losing strength. Although Table 2 illustrates the improved results with molded fiber trays, similar comparative results would also apply to trays made from other materials, for example, polystyrene, polyethylene, or other suitable materials.

TABLE 2

| Group | Tray Weight (g) | Weight Resulting in 1 Inch Deflection (lb) |
|---|---|---|
| 1 | 23.824 | 4.7 |
| 2 | 24.37 | 3.8 |
| 3 | 25.622 | 3.5 |
| 4 | 26.006 | 3.1 |
| 5 | 27.7 | 1.7 |

For purpose of illustration and confirmation of the disclosed subject matter, a greater amount of sidewall surface disposed above divider wall 30 (230, 330, 430, 530, 630) can provide a greater increase in strength compared to flat trays, as illustrated for example in Tables 1 and 2. The additional sidewall surface above the divider wall provides additional deflection strength at the intersection of the divider wall 30 (230, 330, 430, 530, 630) and opposing second sidewalls 22 (222, 322, 422, 522, 622) without decreasing the flush-fill capacities of the compartments $C_1$ and $C_2$. Furthermore, $H_{2MAX}$ can be increased without preventing or inhibiting access to the contents of the tray, which can be accessed over one of the opposing first sidewalls 21 (221, 321, 421, 521, 621).

Further, and referring again to FIG. 1, in some embodiments, the width of the divider wall 30 can increase proximate the intersection with each of the opposing second sidewalls 22. This increased width can enhance strength of the tray, as well as facilitate easier and more cost effective manufacture using conventional thermoforming techniques or the like.

Figure 8:
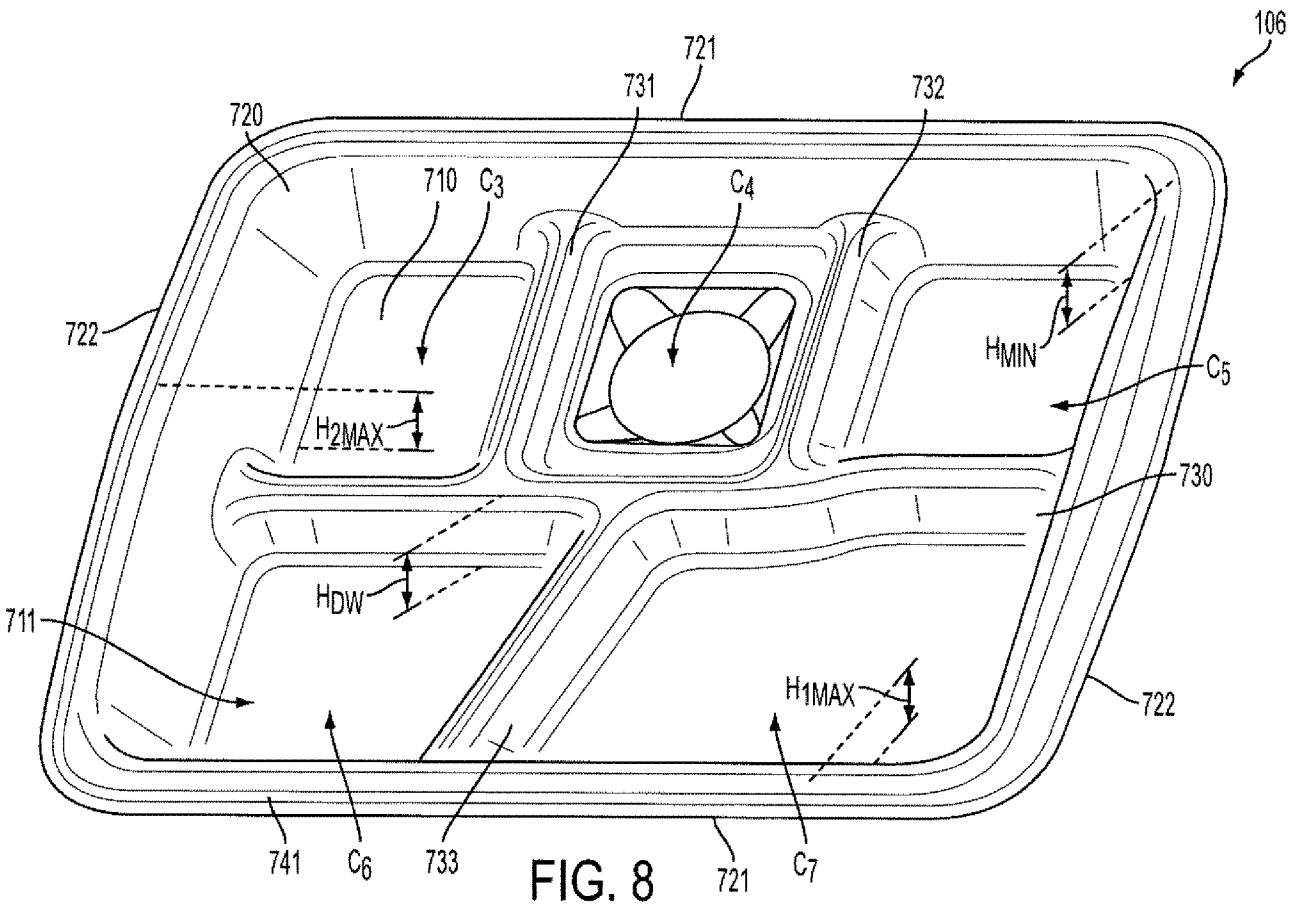
FIG. 8 is a perspective view of the disposable tray of FIG. 7.

In some embodiments, the perimeter wall or at least a portion thereof can further include a flange 40 along the upper end thereof. For example, the set of first sidewalls of the perimeter wall can further include a return flange 741 (as shown in FIG. 8.) at an upper end thereof. Alternatively or additionally, the set of opposing second sidewalls 22 can have a return flange at an upper end thereof. The return flanges can have an arcuate or other shape in cross-section, such as rectangular, curved, an S-shape, a triangular shape, an angled shape, or a stepped shape. Such return flanges can further increase the strength of the tray, as discussed below, as well as facilitate ease of use, such as stacking, lifting, and carrying such trays.

Figure 7:
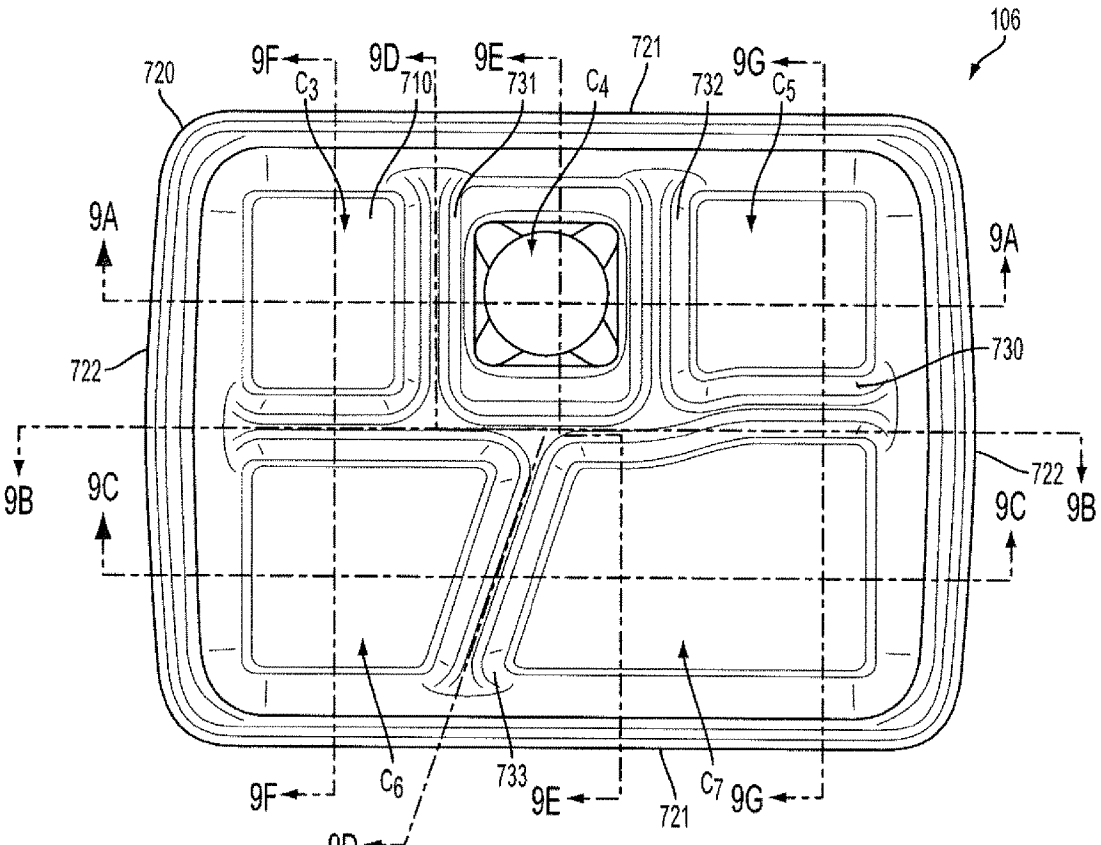
FIG. 7 is a top view of an exemplary embodiment of a multi-compartment disposable tray according to the disclosed subject matter, wherein a plurality of compartments are defined.

According to the disclosed subject matter, a disposable tray is provided with additional features for illustration and not limitation. Reference is now made to FIGS. 7-9, for the purpose of illustration, and not limitation, an exemplary tray 106 is shown. The tray 106 includes a base 710 and a perimeter wall 720. The perimeter wall 720 extends upwardly from the base 710 to define an interior 711. As can be seen in FIGS. 8 and 9, the perimeter wall 720 can extend upwardly at an angle relative to the base 710 to facilitate stacking of a number of substantially similar trays in accordance with another aspect of the disclosed subject matter. The perimeter wall includes a set of opposing first sidewalls 721 and a set of opposing second sidewalls 722. Each of the opposing first sidewalls 721 has a first maximum height $H_{1MAX}$ above the base 710, and each of the opposing second sidewalls 722 has a second maximum height $H_{2MAX}$ above the base 710. Each of the opposing second sidewalls 722 additionally can have a minimum height $H_{MIN}$ above the base 710. The minimum height $H_{MIN}$ can be about equal to the first maximum height $H_{1MAX}$, and the second maximum height $H_{2MAX}$ can be greater than the first maximum height $H_{1MAX}$. In some embodiments, the second maximum height $H_{2MAX}$ can be at least about 12% greater than the first maximum height $H_{1MAX}$.

As shown in FIGS. 7 and 8, the tray 106 also includes a first divider wall 730, which extends upwardly from the base 710. The divider wall 730 extends between the set of opposing second sidewalls 722 to define a plurality of compartments within the interior 711. The divider wall 730 intersects each of the opposing second sidewalls 722 proximate the second maximum height $H_{2MAX}$. For example, the divider wall can have a height $H_{DW}$ above the base 710. In some embodiments, the second maximum height $H_{2MAX}$ can be at least about 120 percent the height of the divider wall $H_{DW}$. As shown for example in FIGS. 7, 8, 9F and 9G, the divider wall can be contoured in plan view. In alternative embodiments, for example, and as discussed in greater detail above with respect to FIGS. 1-6, the divider wall 730 can be straight, such as having a planar shape in plan view.

Tray 106 can further include additional divider walls. For example, and not limitation, the tray 106 includes second 731, third 732, and fourth 733 divider walls. The second divider wall 731 and the third divider wall 732 as embodied herein for illustration only, extend between the first divider wall 730 and one of the first opposing sidewalls 721 to define three compartments ($C_3$, $C_4$, and $C_5$) therein (see e.g., FIG. 9A). The fourth divider wall 733 as depicted herein extends between the first divider wall 730 and the other of the first opposing sidewalls 721, to define two compartments ($C_6$ and $C_7$) therein (see e.g., FIG. 9C). As embodied herein, the fourth divider 733 wall can have an angled shape in plan view, thereby defining compartments ($C_6$ and $C_7$) having different volumes. Although four divider walls are shown, it is understood that any suitable number of divider walls can be provided to define any desired number of compartments. In some embodiments, the width of the divider walls can increase proximate the intersections with each other or with sidewalls.

Figure 9D:
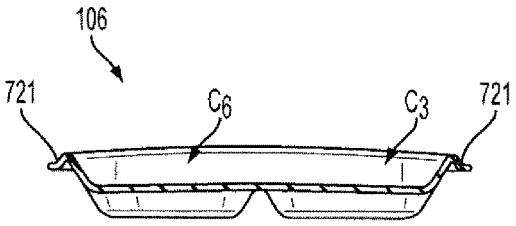
FIG. 9D is a cross-sectional view taken along line 9D of FIG. 7.
Figure 9E:
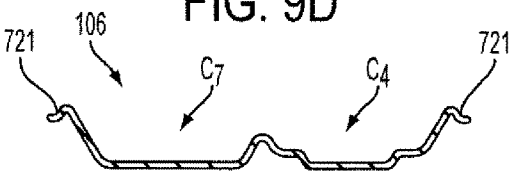
FIG. 9E is a cross-sectional view taken along line 9E of FIG. 7.
Figure 9F:
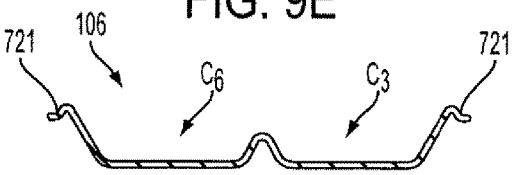
FIG. 9F is a cross-sectional view taken along line 9F of FIG. 7.
Figure 9G:
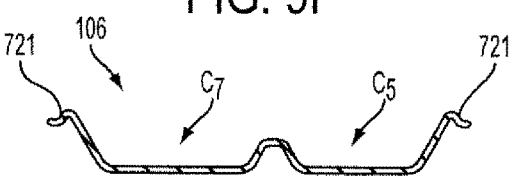
FIG. 9G is a cross-sectional view taken along line 9G of FIG. 7.
Figure 9A:
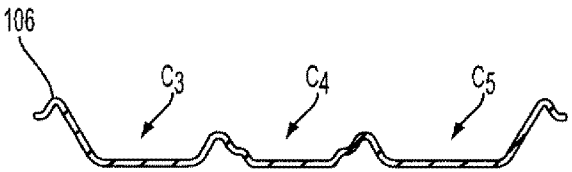
FIG. 9A is a cross-sectional view taken along line 9A of FIG. 7.
Figure 9B:
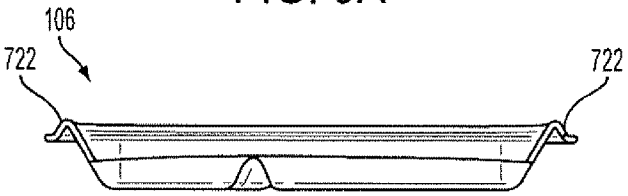
FIG. 9B is a cross-sectional view taken along line 9B of FIG. 7.
Figure 9C:
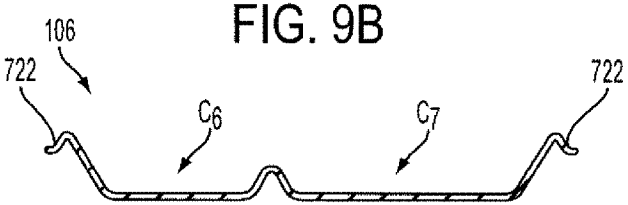
FIG. 9C is a cross-sectional view taken along line 9C of FIG. 7.

In some embodiments, one or more compartments can have a partially raised bottom. For example, FIGS. 8 and 9E illustrate a compartment $C_4$ having a raised bottom. The raised bottom can be used, for example and without limitation, to support or inhibit lateral movement of a drink or other food products in the compartment.

As shown in FIGS. 8 and 9, for the purpose of illustration and not limitation, tray 106 can further include a return flange 741 along at least a portion of the upper end of the perimeter wall. For example, return flange 741 can increase the strength of the disposable tray. The return flange 741 of the set of opposing first sidewalls can have a constant height $H_{1MAX}$. As illustrated in FIG. 8, the return flange 741 of the set of opposing second sidewalls can have an arcuate shape in cross-section. Accordingly, the second maximum height $H_{2MAX}$ can be defined proximate the center of the length of each of the opposing second sidewalls, while the minimum height $H_{MIN}$ can be defined proximate the ends of each of the opposing second sidewalls. The arced return flange proximate the intersection of the divider wall 730 and each of the opposing second sidewalls 722, respectively, can be configured to further increase the strength of the tray. Furthermore, with such return flanges, the set of opposing first sidewalls 721 can be provided with a lower relative height without compromising strength and thus providing less restriction of food access. For purpose of comparison, a disposable tray having an arcuate return flange can have increased strength of approximately 43.5% in one-handed carrying, and of approximately 9.9% in two-handed carrying, compared to conventional flat trays (i.e., conventional trays having walls of uniform height $H_{1MAX}$ for both sets of opposing sidewalls). Alternatively, the return flange can have any other suitable shape in cross-section, such as but not limited to rectangular, curved, an S-shape, a triangular shape, an angled shape, or a stepped shape.

The tray can be made of any suitable materials, including, but not limited to, polystyrene foam, ridged sheet, molded fiber, and aluminum. The tray can be formed through any suitable method, including, but not limited to, thermoforming, injection molding, molded-fiber, stamped metal/metal foil, pressed paper, or the like.

Figure 10:
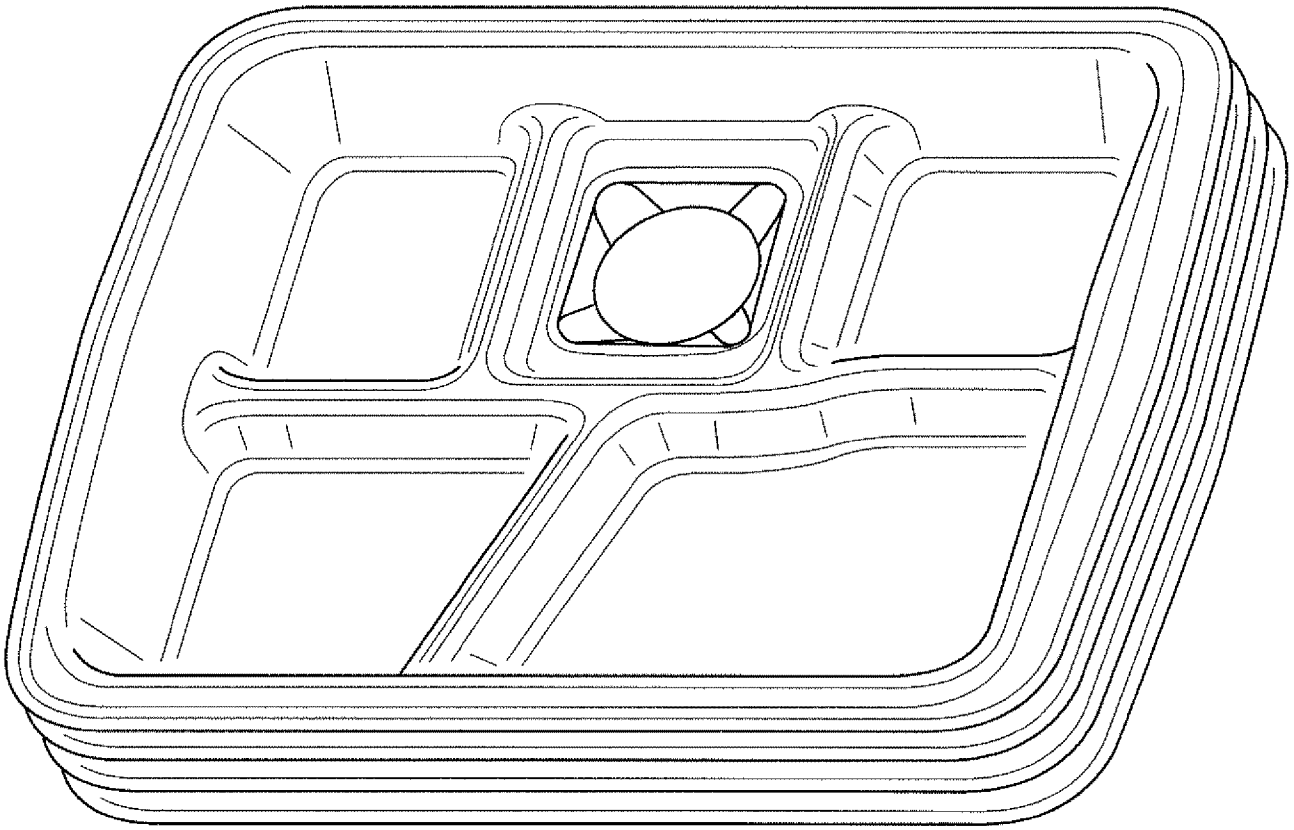
FIG. 10 is a cross-sectional view of a number of disposable trays stacked together according to the disclosed subject matter.

As shown in FIG. 10, for the purpose of illustration and not limitation, a plurality of trays having substantially similar shapes can be stacked together. For example, the divider walls and return flanges of a first tray can fit nestingly into the corresponding divider walls and return flanges of a second tray. Furthermore, providing a perimeter wall that extends upwardly from the base at an angle can improve stackability.

While the disclosed subject matter is described herein in terms of certain preferred embodiments, those skilled in the art will recognize that various modifications and improvements can be made to the disclosed subject matter without departing from the scope thereof. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. A disposable tray comprising:

a base;

a perimeter wall extending upwardly from the base to define an interior, the perimeter wall including a set of opposing first sidewalls and a set of opposing second sidewalls, each of the opposing first sidewalls having a first maximum height above the base and each of the opposing second sidewalls having a second maximum height above the base; and a first divider wall extending upwardly from the base, the first divider wall having a length extending between the set of opposing second sidewalls to define a plurality of compartments within the interior, the first divider wall having a varied height along the length including a minimum height of the first divider wall located proximate an intersection between the first divider wall and each of the opposing second sidewalls, wherein the first divider wall increases in width in plan view proximate the intersection between the first divider wall and each of the opposing second sidewalls, and the second maximum height is at least 120% a maximum height of the first divider wall;

wherein the tray comprises a thermoformed polystyrene foam.

2. The disposable tray of claim 1, wherein each of the opposing second sidewalls further has a minimum height above the base; and wherein the minimum height is about equal to the first maximum height.

3. The disposable tray of claim 2, wherein each of the second sidewalls is arced in cross-section.

4. The disposable tray of claim 2, wherein the second maximum height is at least about 12% greater than the first maximum height.

5. The disposable tray of claim 2, further including a flange extending along an upper end of the perimeter wall.

6. The disposable tray of claim 2, wherein a flange along an upper end of the perimeter wall is a return flange.

7. The disposable tray of claim 6, wherein the return flange along each second sidewall is arced in cross-section.

8. The disposable tray of claim 6, wherein the return flange along each second sidewall is S-shaped in cross-section.

9. The disposable tray of claim 1, wherein the first divider wall is straight in plan view.

10. The disposable tray of claim 1, wherein the first divider wall is contoured in plan view.

11. The disposable tray of claim 1, further comprising at least one secondary divider wall disposed between the first divider wall and one of the opposing first sidewalls to define a plurality of compartments therebetween.

12. The disposable tray of claim 11, wherein the secondary divider wall comprises an angled shape in plan view to define two compartments having different volumes.

13. The disposable tray of claim 1, wherein the perimeter wall extends upwardly at an angle from the base.

14. The disposable tray of claim 1, wherein the tray weighs less than 25 grams and wherein at least 3.5 pounds applied proximate a midpoint of one of the first set of sidewalls is required for deflection of at least about 1 inch measured at the midpoint of the one of the first set of sidewalls when the tray is supported proximate where the other of the first set of opposing sidewalls meets each of the second set of opposing sidewalls.

15. The disposable tray of claim 1, wherein the tray weighs less than 25 grams and wherein at least 4.0 pounds applied proximate a midpoint of one of the first set of sidewalls is required for deflection of at least about 1 inch measured at the midpoint of the one of the first set of sidewalls when the tray is supported proximate where the other of the first set of opposing sidewalls meets each of the second set of opposing sidewalls.

16. A disposable tray comprising:

a base;

a perimeter wall extending upwardly from the base to define an interior, the perimeter wall including a set of opposing first sidewalls and a set of opposing second sidewalls, each of the opposing first sidewalls having a first maximum height above the base and each of the opposing second sidewalls having a minimum height and a second maximum height above the base; and a first divider wall extending upwardly from the base, the first divider wall having a length extending between the set of opposing second sidewalls to define a plurality of compartments within the interior, the first divider wall having a varied height along the length including a minimum height of the first divider wall located proximate an intersection between the first divider wall and each of the opposing second sidewalls;

a second divider wall extending upwardly from the base, the second wall having a length extending between the first divider wall and one the opposing first sidewalls, the second divider wall having an angled shape in plan view to define two compartments having different volumes, wherein the first divider wall increases in width in plan view proximate the intersection between the first divider wall and each of the opposing second sidewalls, and the second maximum height is at least 120% a maximum height of the first divider wall;

wherein the tray comprises a thermoformed polystyrene foam.

17. The disposable tray of claim 16, wherein the second maximum height is at least about 12% greater than the first maximum height.

18. The disposable tray of claim 16, further comprising at least one third divider wall disposed between the first divider wall and the other of the opposing first sidewalls to define a plurality of compartments therebetween.

19. The disposable tray of claim 16, wherein the perimeter wall extends upwardly at an angle from the base.

20. The disposable tray of claim 16, wherein the tray weighs less than 25 grams and wherein at least 3.5 pounds applied proximate a midpoint of one of the first set of sidewalls is required for deflection of at least about 1 inch measured at the midpoint of the one of the first set of sidewalls when the tray is supported proximate where the other of the first set of opposing sidewalls meets each of the second set of opposing sidewalls.

21. The disposable tray of claim 16, wherein the tray weighs less than 25 grams and wherein at least 4.0 pounds applied proximate a midpoint of one of the first set of sidewalls is required for deflection of at least about 1 inch measured at the midpoint of the one of the first set of sidewalls when the tray is supported proximate where the other of the first set of opposing sidewalls meets each of the second set of opposing sidewalls.

22. The disposable tray of claim 16, wherein each of opposing first sidewalls comprises a return flange, and each of opposing second sidewalls comprises an arced return flange.

23. A disposable tray comprising:

a base;

a perimeter wall extending upwardly from the base to define an interior, the perimeter wall including a set of opposing first sidewalls and a set of opposing second sidewalls, each of the opposing first sidewalls having a first maximum height above the base and each of the opposing second sidewalls having a second maximum height above the base; and a first divider wall extending upwardly from the base, the divider wall having a length extending between the set of opposing second sidewalls to define a plurality of compartments within the interior, the divider wall having a varied height along the length including a minimum height of the divider wall located proximate an intersection between the divider wall and each of the opposing second sidewalls, wherein the divider wall increases in width in plan view proximate the intersection between the divider wall and each of the opposing second sidewalls, and the second maximum height is at least 120% a maximum height of the divider wall; wherein the tray weighs less than 25 grams and wherein at least 3.5 pounds applied proximate a midpoint of one of the first set of sidewalls is required for deflection of at least about 1 inch measured at the midpoint of the one of the first set of sidewalls when the tray is supported proximate where the other of the first set of opposing sidewalls meets each of the second set of opposing sidewalls;

wherein the tray comprises a thermoformed polystyrene foam.

* * * * *